US010250966B2

(12) United States Patent
Zheng et al.

(10) Patent No.: US 10,250,966 B2
(45) Date of Patent: Apr. 2, 2019

(54) ELECTROSTATIC LOUDSPEAKER AND ELECTROSTATIC HEADPHONE

(71) Applicant: Transound Electronics Co., Ltd., Dongguan, Guangdong (CN)

(72) Inventors: Huming Zheng, Dongguan (CN); Zhijian He, Dongguan (CN); Xiaolin Deng, Dongguan (CN); Tseng-Feng Wen, Dongguan (CN)

(73) Assignee: TRANSOUND ELECTRONICS CO., LTD., Dongguan, Guangdong (CN)

( * ) Notice: Subject to any disclaimer, the term of this patent is extended or adjusted under 35 U.S.C. 154(b) by 0 days.

(21) Appl. No.: 15/813,164

(22) Filed: Nov. 15, 2017

(65) Prior Publication Data

US 2018/0184193 A1 Jun. 28, 2018

(30) Foreign Application Priority Data

Dec. 23, 2016 (CN) ..... 2016 2 1424065 U

(51) Int. Cl.
*H04R 19/02* (2006.01)
*H04R 1/10* (2006.01)

(52) U.S. Cl.
CPC ..... *H04R 1/1066* (2013.01); *H04R 1/105* (2013.01); *H04R 1/1016* (2013.01); *H04R 19/02* (2013.01)

(58) Field of Classification Search
CPC .... H04R 1/1066; H04R 1/1016; H04R 1/105; H04R 19/02
See application file for complete search history.

(56) References Cited

U.S. PATENT DOCUMENTS

2013/0202127 A1* 8/2013 Miyakura ..... H04R 19/013 381/74
2014/0064510 A1* 3/2014 Grinnip, III ..... C08B 37/0072 381/74
2018/0227674 A1* 8/2018 Gabai ..... H04R 19/02

* cited by examiner

*Primary Examiner* — Brian Ensey
(74) *Attorney, Agent, or Firm* — Leong C. Lei

(57) ABSTRACT

An electrostatic loudspeaker and an electrostatic headphone are provided. The electrostatic loudspeaker includes a first back grid portion, a second back grid portion, a diaphragm portion, and an audio amplifier circuit module. The two polarized and charged back grid portions are combined with the diaphragm portion to form two alternating electric fields, providing great sound. The structure is simple and can be assembled conveniently.

10 Claims, 7 Drawing Sheets

ELECTROSTATIC LOUDSPEAKER AND ELECTROSTATIC HEADPHONE

BACKGROUND OF THE INVENTION

1. Field of the Invention

The present invention relates to a headphone, and more particularly to an electrostatic loudspeaker and an electrostatic headphone.

2. Description of the Prior Art

An electrostatic loudspeaker is a loudspeaker design in which sound is generated by the force exerted on a diaphragm suspended in an electrostatic field. Advantages of electrostatic loudspeakers include levels of distortion one to two orders of magnitude lower than conventional cone drivers in a box. The extremely light weight of the diaphragm which is driven across its whole surface, and exemplary frequency response (both in amplitude and phase) because the principle of generating force and pressure is almost free from resonances unlike the more common electrodynamic driver. Musical transparency can be better than in electrodynamic loudspeakers because the radiating surface has much less mass than most other drivers and is therefore far less capable of storing energy to be released later. A conventional electrostatic loudspeaker comprises two grids connected to two poles of an amplifier circuit. An electret thin film layer is disposed on the diaphragm. The diaphragm is not connected with the amplifier circuit. Although this electrostatic loudspeaker can sound, the power is small, and the sound is very small, and it cannot meet the practical needs. Therefore, the existing electrostatic loudspeakers should be improved to solve the above problems. Accordingly, the inventor of the present invention has devoted himself based on his many years of practical experiences to solve these problems.

SUMMARY OF THE INVENTION

In view of the shortcomings of the prior art, the primary object of the present invention is to provide an electrostatic loudspeaker and an electrostatic headphone. Two polarized and charged back grid portions are combined with a diaphragm portion to form two alternating electric fields, providing great sound. The structure is simple and can be assembled conveniently.

According to one aspect of the present invention, an electrostatic loudspeaker is provided. The electrostatic loudspeaker comprises a first back grid portion, a second back grid portion, a diaphragm portion, and an audio amplifier circuit module. The first back grid portion, the second back grid portion and the diaphragm portion are arranged in parallel to each other. The first back grid portion includes a first connecting ring and a polarized and charged first grid which are in electrical contact with each other. The first grid is provided with a plurality of first through holes.

The second back grid portion includes a second connecting ring and a polarized and charged second grid which are in electrical contact with each other. The second grid is opposite in polarity to the first grid. Relative positive and negative values of surface potentials of the first grid and the second grid are matched with each other. The second grid is provided with a plurality of second through holes corresponding to the first through holes of the first grid. The first grid and the second gird are arranged face to face. Opposing surfaces of the first grid and the second grid are provided with electret thin film layers having permanent charges, respectively.

The diaphragm portion includes a first diaphragm ring, a second diaphragm ring, and a diaphragm. Two surfaces of the diaphragm are coated with metal layers, respectively. The diaphragm is sandwiched between the first diaphragm ring and the second diaphragm ring. The two surfaces of the diaphragm are in electrical contact with the first diaphragm ring and the second diaphragm ring, respectively. One end of the audio amplifying circuit module is connected with the first connecting ring and the second connecting ring. Another end of the audio amplifying circuit module is connected with one of the first diaphragm ring and the second diaphragm ring.

According to another aspect of the present invention, an electrostatic headphone is provided. The electrostatic headphone comprises an earphone housing and the aforesaid electrostatic loudspeaker. The electrostatic loudspeaker is disposed in the earphone housing.

Compared with the prior art, the present invention has obvious advantages and beneficial effects.

1. Through the design of the electrostatic loudspeaker, the two polarized and charged back grid portions are combined with the diaphragm portion, and the two back grid portions are connected to one end of the audio amplifier circuit module, and the diaphragm portion is connected to the other end of the audio amplifier circuit module, so that the two back grid portions and the diaphragm produce respective alternating electric fields to make at least twice the sound of the conventional electrostatic loudspeaker so as to meet the user's needs.

2. Through the improved design of the headband structure, the headphone provides two use modes, a head-mounted headphone and an in-ear earphone. It is convenient and practical for use. The headphone has the advantages of simple and stable structure and easy production and assembly.

3. The headphone is provided with the first waterproof net, the second waterproof net and the third waterproof net to improve the waterproof performance of the loudspeaker in the headphone and the entire headphone, thereby prolonging the service life of the headphone.

4. The central axis of the sound tube is set at an angle with respect to the central axis of the rear housing. This design is more ergonomic. The user's ear won't feel tired after a long time of use.

DETAILED DESCRIPTION OF THE PREFERRED EMBODIMENTS

Embodiments of the present invention will now be described, by way of example only, with reference to the accompanying drawings.

Figure 1:
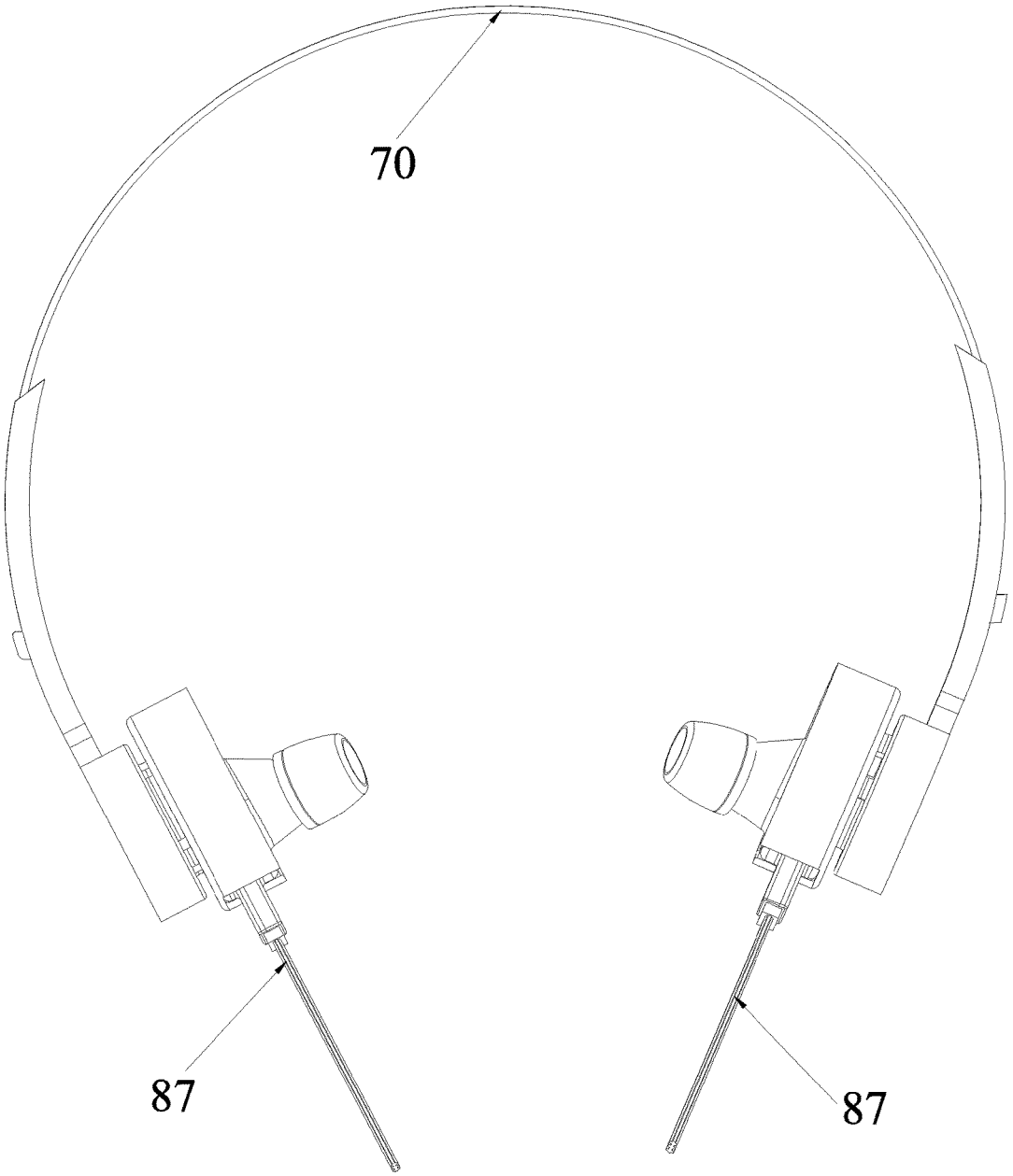
FIG. 1 is a perspective view in accordance with an embodiment of the present invention.
Figure 2:
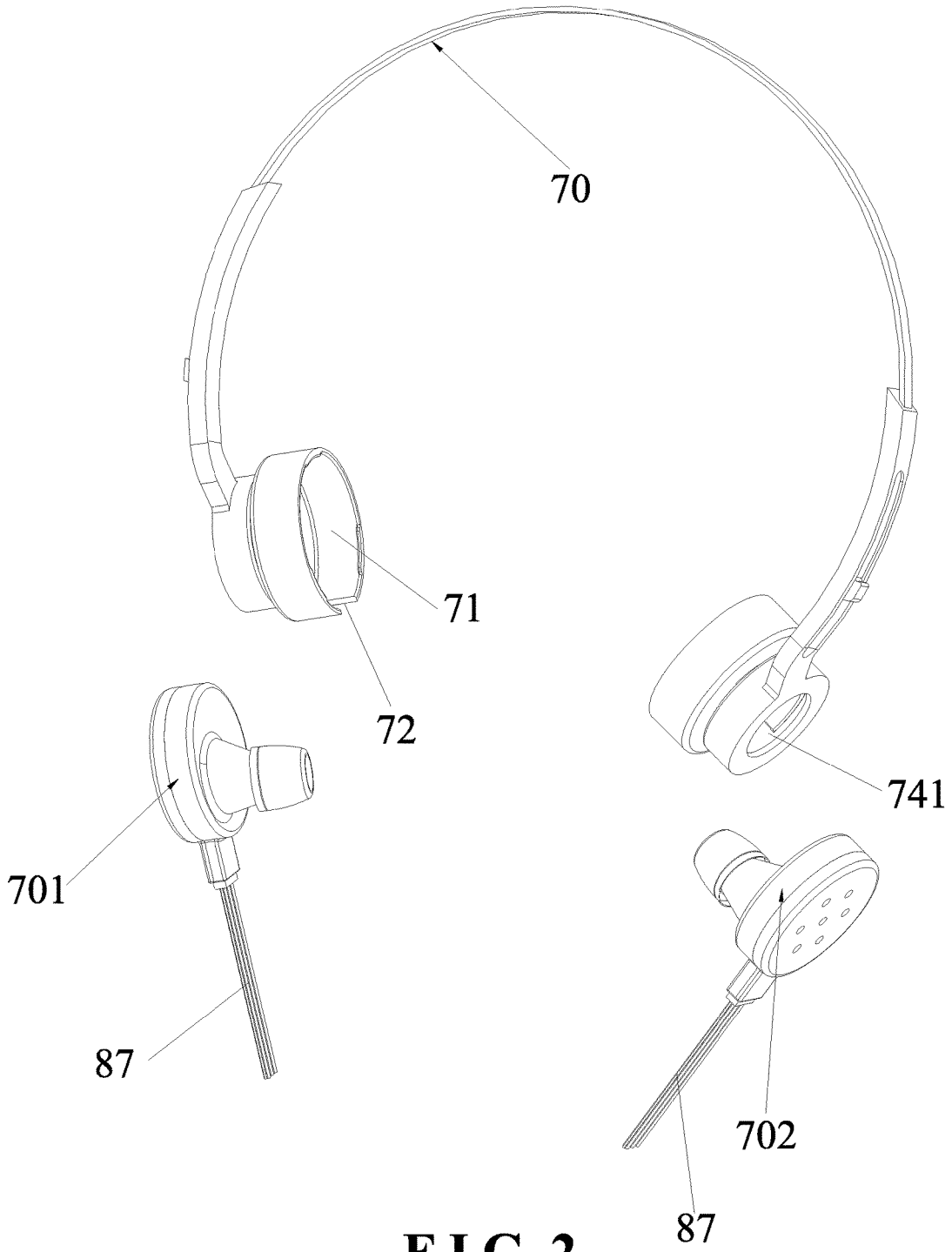
FIG. 2 is a first exploded view in accordance with the embodiment of the present invention.
Figure 3:
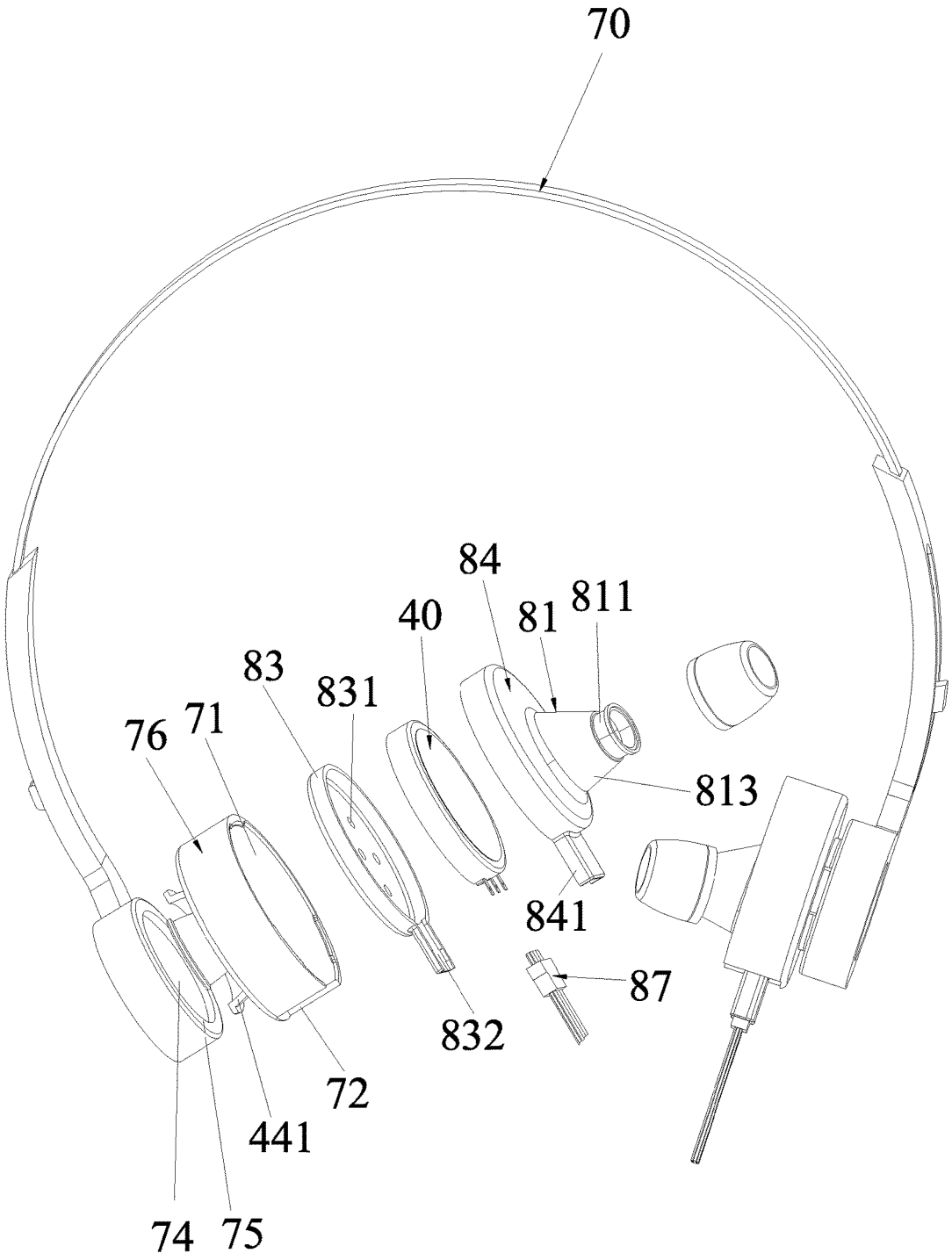
FIG. 3 is a second exploded view in accordance with the embodiment of the present invention.
Figure 4:
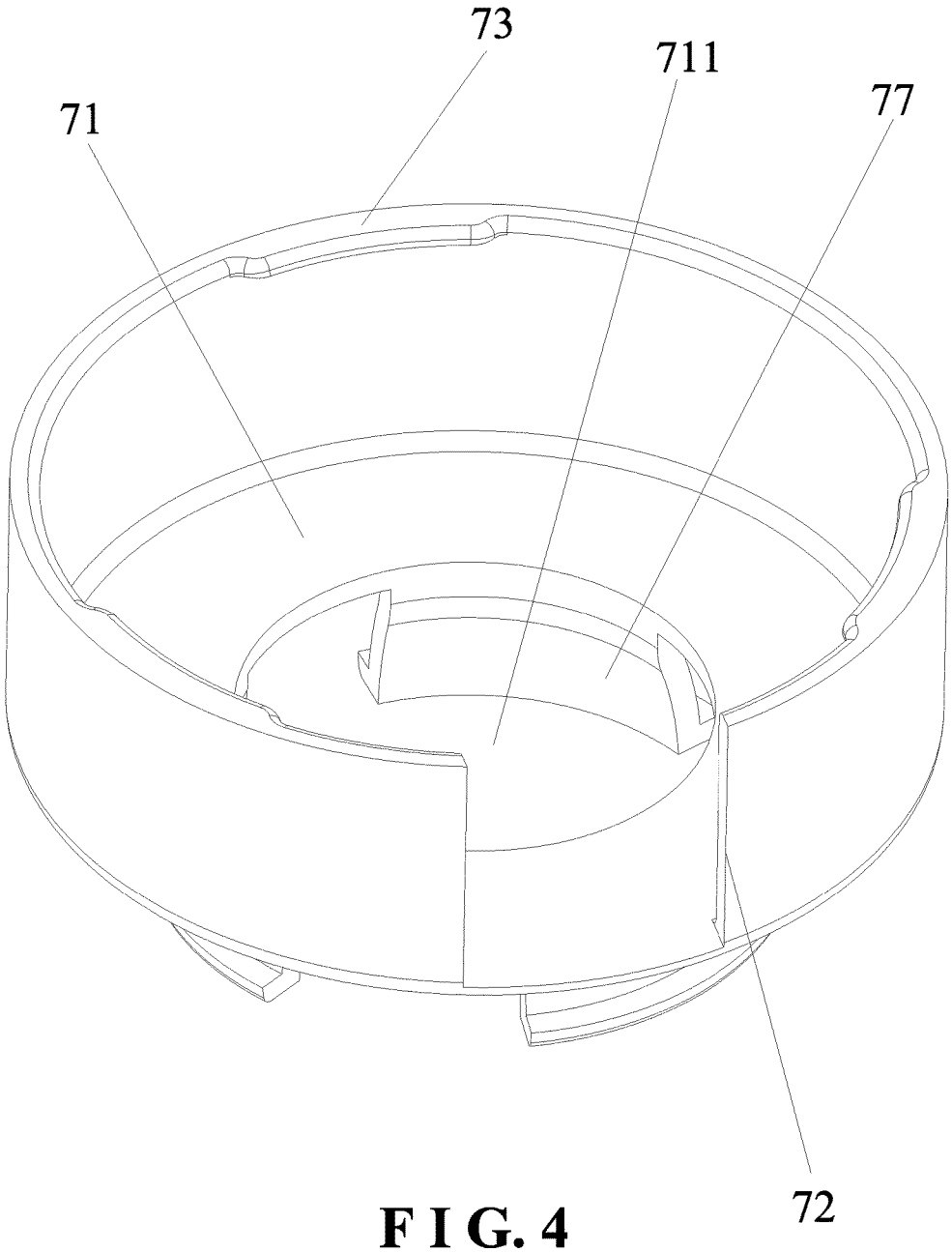
FIG. 4 is a perspective view of the connecting structure in accordance with the embodiment of the present invention.
Figure 5:
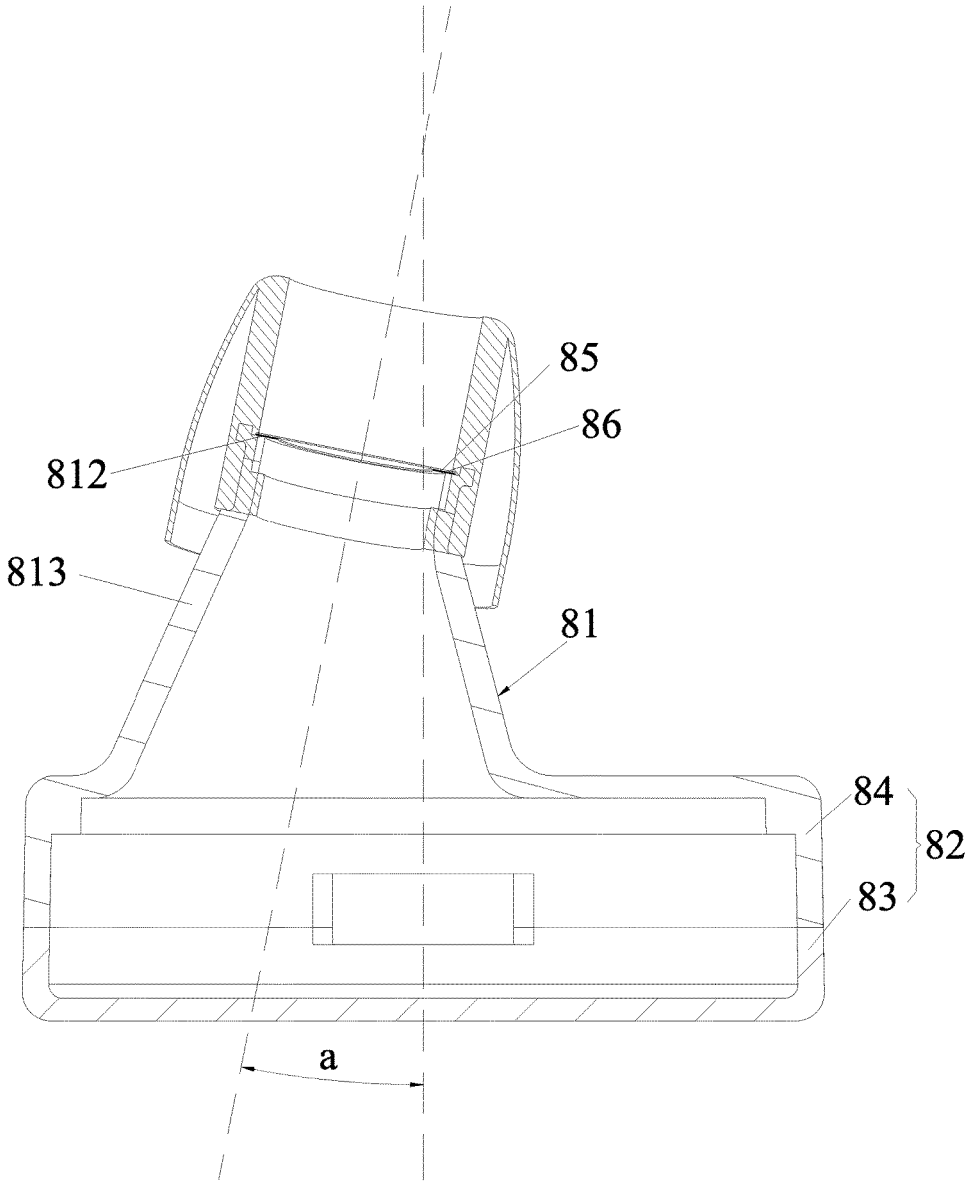
FIG. 5 is a sectional view of the earphone housing in accordance with the embodiment of the present invention.
Figure 6:
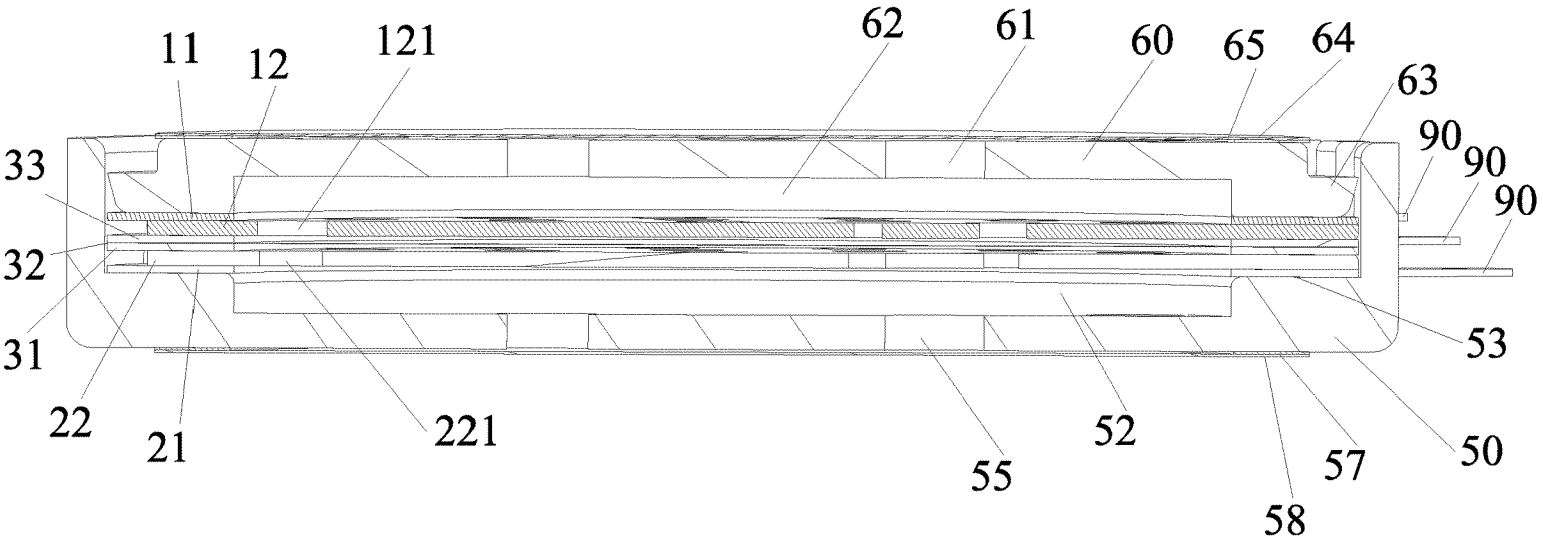
FIG. 6 is a sectional view of the loudspeaker in accordance with the embodiment of the present invention.
Figure 7:
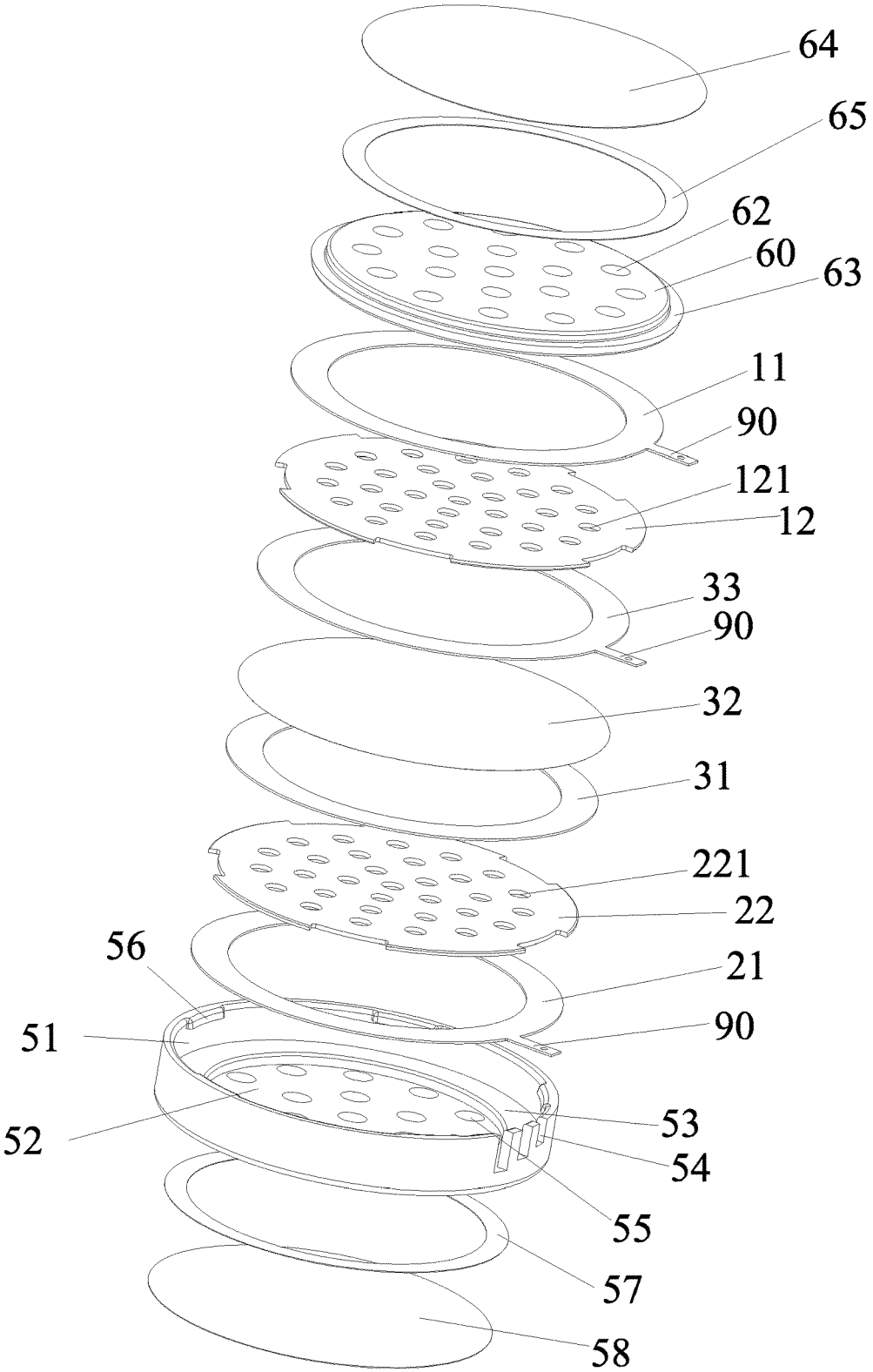
FIG. 7 is an exploded view of the loudspeaker in accordance with the embodiment of the present invention.

As shown in FIG. 1 to FIG. 7, the present invention discloses an electrostatic loudspeaker and an electrostatic headphone. In this description, a detachable dual-purpose headphone is taken as an example. However, the electrostatic loudspeaker is not limited to be applied to the headphone of such a structure. Similarly, the electrostatic headphone is not limited to the design of such a structure.

Specifically, the electrostatic headphone comprises a headband 70, a left earphone 701 and a right earphone 702 detachably mounted to the headband 70, an earphone housing, and an electrostatic loudspeaker 40. The electrostatic loudspeaker is disposed in the earphone housing. The earphone housing includes a left earphone housing and a right earphone housing. The electrostatic loudspeaker 40 is disposed in the left earphone housing to form the left earphone 701. The electrostatic loudspeaker 40 is disposed in the right earphone housing to form the right earphone 702. The headband 70 is detachably connected between the left earphone 701 and the right earphone 702. Two ends of the headband 70 are provided with earphone accommodation chambers 71 each having a mounting inlet. An outer wall of the earphone accommodation chamber 71 is formed with an earphone wire positioning opening 72 communicating with the earphone accommodation chamber 71. The outer wall of the earphone accommodation chamber 71, corresponding to the periphery of the mounting inlet, is provided with a limit block 73 extending inward. The left earphone 701 and the right earphone 702 each have an earphone wire 87 and an ear insertion portion 81 protruding from a corresponding one of the left earphone housing and the right earphone housing. The left earphone housing and the right earphone housing are detachably assembled through the mounting inlet in the corresponding earphone accommodation chambers 71, respectively. The limit block 73 is limited to an inner side of the left earphone housing and the right earphone housing. The earphone wire 87 extends outward from the earphone wire positioning opening. The two ends of the headband 70 are connected with connecting structures 76, respectively. The earphone accommodation chambers 71 are formed in the connecting structures 76, respectively. An outer side of each connecting structure 76 is connected with an elastic buckle 77. The two ends of the headband 70 are formed with buckle troughs 74, respectively. Each buckle trough 74 has an annular engaging edge 75. The elastic buckle 77 is engaged in the buckle trough 74 and is confined to the annular engaging edge 75. In this embodiment, the earphone accommodation chamber 71 has a first hole 711 arranged opposite to the mounting inlet. The buckle trough 74 has a second hole 741 formed at each of the two ends of the headband 70.

The electrostatic loudspeaker 40 comprises a first back grid portion 10, a second back grid portion 20, a diaphragm portion 30, an audio amplifier circuit module (not shown in the drawings), a bracket 50, and a front cover 60.

The first back grid portion 10, the second back grid portion 20, and the diaphragm portion 30 are arranged in parallel to each other.

The first back grid portion 10 includes a first connecting ring 11 and a first grid 12 which are in electrical contact with each other. The first grid 12 is provided with a plurality of first through holes 121.

The second back grid portion 20 includes a second connecting ring 21 and a second grid 22 which are in electrical contact with each other. The second grid 22 is provided with a plurality of second through holes 221 corresponding to the first through holes 121 of the first grid 12. The first grid 12 and the second gird 22 are arranged face to face. Opposing surfaces of the first grid 12 and the second grid 22 are provided with electret thin film layers 80 having permanent charges, respectively.

The diaphragm portion 30 includes a first diaphragm ring 31, a diaphragm 32, and a second diaphragm ring 33. The diaphragm 32 is sandwiched between the first diaphragm ring 31 and the second diaphragm ring 33. Two surfaces of the diaphragm 32 are coated with metal layers which are in electrical contact with the first diaphragm ring 31 and the second diaphragm ring 33, respectively. The first diaphragm ring 31 and the diaphragm 32 are bonded together by glue.

Lower ends of the first connecting ring 11, the second connecting ring 21, and the second diaphragm ring 33 are provided with pins 90 connected with the audio amplifier circuit module, respectively.

One end of the audio amplifying circuit module is connected with the pins 90 of the first connecting ring 11 and the second connecting ring 21, and another end of the audio amplifying circuit module is connected with the pin 90 of the second diaphragm ring 33.

The bracket 50 has a cylindrical shape. The bracket 50 has a bracket accommodation chamber 51. The first back grid portion 10, the second back grid portion 20, and the diaphragm portion 30 are mounted in the bracket accommodation chamber 51. The bracket accommodation chamber 51 is further recessed with a gap trough 52. An inner bottom surface of the bracket accommodation chamber 51 is formed with a mounting surface 53 around the gap trough 52. The second connecting ring 21 is horizontally mounted on the mounting surface 53. An outer wall of the bracket accommodation chamber 51 is formed with three spaced notches 54 for the pins 90 to extend therefrom. The pins 90 extend out of the bracket 50 from the corresponding notches 54. A rear wall of the gap trough 52 is formed with third through holes 55. The front cover 60 is disposed at the front of the bracket accommodation chamber 51. The front cover 60 has a receiving trough 62. An inner wall of the receiving trough 62 is formed with fourth through holes 61. The periphery of the front cover 60 extends outward to form an annular flange 63. The bracket 50 is provided with an engaging protrusion 56 corresponding to the annular flange 63. The front cover 60 is connected to the bracket 50. The annular flange 63 is mated with the engaging protrusion 56. In this embodiment, a rear wall of the bracket 50, corresponding to the third through holes 55, is provided with a first annular gasket 57 and a first waterproof net 58 arranged in sequence from front to back, and a front wall of the front cover 60, corresponding to the fourth through holes 61, is provided with a second waterproofing net 64 and a second annular gasket 65 arranged in sequence from front to back, thereby enhancing waterproof performance.

The ear insertion portion 81 is fitted with an earplug sleeve which is a bullet-shaped silicone earplug sleeve or a sports silicone earplug sleeve. In this embodiment, the earphone housing includes a front housing 83 and a rear housing 84. The front housing 83 is provided with a sound hole 831. The front housing 83 and the rear housing 84 have a first mounting portion 832 and a second mounting portion 841 corresponding to the notches 54, respectively. The front housing 83 and the rear housing 84 are connected to each other to form a mounting cavity therein. The aforesaid electrostatic loudspeaker 40 is installed in the mounting cavity. The ear insertion portion 81 is disposed at an end of the rear housing 84. An outer wall of the ear insertion portion 81 is formed with a groove 811. The earplug sleeve is fitted to the groove 811. The ear insertion portion 81 has a sound chamber. An inner wall of the sound chamber has a limit step 812. The limit step 812 is provided with a third annular gasket 85. The third annular gasket 85 is provided with a third waterproofing net 86, thereby enhancing the waterproof performance.

In this embodiment, the ear insertion portion 81 has a sound tube 813. The central axis of the sound tube 813 is set at an angle a with respect to the central axis of the rear housing 84. The angle a is in the range of 15-30 degrees. The sound tube 813 is disposed at an angle relative to the rear housing 84, which is more ergonomic. The user's ear won't feel tired after a long time of use. Because the structure is in close contact with the user's ear, the earphone won't fall off from the user's ear.

The working principle of the electrostatic loudspeaker is described hereinafter. An alternating electric field is formed between the first back grid portion 10 and the diaphragm portion 30. Another alternating electric field is formed between the second back grid portion 20 and the diaphragm portion 30. The charges of the two alternating electric fields act on the electrostatic field of the diaphragm 32 to vibrate the diaphragm 32 to produce an audio signal which is amplified by the audio amplifier circuit module to make a sound. It is to be noted that the first grid 12 and the second grid 22 must be polarized and charged before assembly. One of the electret thin film layers 80 of the two grids 12, 22 is polarized and charged with a positive charge, and the other one is polarized and charged with a negative charge. The relative positive and negative values of the surface potentials of the two grids must be matched (consistent or close).

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An electrostatic loudspeaker, comprising a first back grid portion, a second back grid portion, a diaphragm portion, and an audio amplifier circuit module; the first back grid portion, the second back grid portion and the diaphragm portion being arranged in parallel to each other; the first back grid portion including a first connecting ring and a polarized and charged first grid which are in electrical contact with each other, the first grid being provided with a plurality of first through holes;

the second back grid portion including a second connecting ring and a polarized and charged second grid which are in electrical contact with each other, the second grid being opposite in polarity to the first grid, relative positive and negative values of surface potentials of the first grid and the second grid being matched with each other, the second grid being provided with a plurality of second through holes corresponding to the first through holes of the first grid, the first grid and the second gird being arranged face to face, opposing surfaces of the first grid and the second grid being provided with electret thin film layers having permanent charges respectively;

the diaphragm portion including a first diaphragm ring, a second diaphragm ring and a diaphragm, two surfaces of the diaphragm being coated with metal layers respectively, the diaphragm being sandwiched between the first diaphragm ring and the second diaphragm ring, the two surfaces of the diaphragm being in electrical contact with the first diaphragm ring and the second diaphragm ring respectively; one end of the audio amplifying circuit module being connected with the first connecting ring and the second connecting ring, another end of the audio amplifying circuit module being connected with one of the first diaphragm ring and the second diaphragm ring.

2. The electrostatic loudspeaker as claimed in claim 1, wherein lower ends of the first connecting ring, the second connecting ring and one of the first diaphragm ring and the second diaphragm ring are provided with pins connected with the audio amplifier circuit module, respectively.

3. The electrostatic loudspeaker as claimed in claim 1, further comprising a bracket, the bracket having a cylindrical shape, the bracket having a bracket accommodation chamber, the first back grid portion, the second back grid portion and the diaphragm portion being mounted in the bracket accommodation chamber; the bracket accommodation chamber being further recessed with a gap trough, an inner bottom surface of the bracket accommodation chamber being formed with a mounting surface around the gap trough, the second connecting ring being horizontally mounted on the mounting surface; an outer wall of the bracket accommodation chamber being formed with three spaced notches for the pins to extend therefrom, the pins extending out of the bracket from the corresponding notches respectively, a rear wall of the gap trough being formed with third through holes; a front cover being disposed at a front of the bracket accommodation chamber, the front cover having a receiving trough, an inner wall of the receiving trough being formed with fourth through holes, a periphery of the front cover extending outward to form an annular flange, the bracket being provided with an engaging protrusion corresponding to the annular flange, the front cover being connected to the bracket, the annular flange being mated with the engaging protrusion.

4. The electrostatic loudspeaker as claimed in claim 1, wherein the first diaphragm ring and the diaphragm are bonded together.

5. An electrostatic headphone, comprising an earphone housing and the electrostatic loudspeaker as claimed in claim 1, the electrostatic loudspeaker being disposed in the earphone housing.

6. The electrostatic headphone as claimed in claim 5, wherein the earphone housing includes a left earphone housing and a right earphone housing, the electrostatic loudspeaker is disposed in the left earphone housing to form a left earphone, the electrostatic loudspeaker is disposed in the right earphone housing to form a right earphone; a headband is detachably connected between the left earphone and the right earphone;

two ends of the headband are provided with earphone accommodation chambers each having a mounting inlet, an outer wall of the earphone accommodation chamber is formed with an earphone wire positioning opening communicating with the earphone accommodation chamber, the outer wall of the earphone accommodation chamber, corresponding to a periphery of the mounting inlet, is provided with a limit block extending inward;

the left earphone and the right earphone each have an earphone wire and an ear insertion portion protruding from a corresponding one of the left earphone housing and the right earphone housing;

the left earphone and the right earphone are detachably assembled through the mounting inlet in the corresponding earphone accommodation chambers respectively, the limit block is limited to an inner side of the left earphone housing and the right earphone housing, and the earphone wire extends outward from the earphone wire positioning opening.

7. The electrostatic headphone as claimed in claim 6, wherein the two ends of the headband are connected with connecting structures, the earphone accommodation chambers are formed in the connecting structures respectively, an outer side of each connecting structure is connected with an elastic buckle, the two ends of the headband are formed with buckle troughs, each buckle trough has an annular engaging edge, the elastic buckle is engaged in a corresponding one of the buckle troughs and is confined to the annular engaging edge.

8. The electrostatic headphone as claimed in claim 6, wherein the electrostatic loudspeaker further comprises a bracket, the bracket has a cylindrical shape, the bracket has a bracket accommodation chamber, the first back grid portion, the second back grid portion and the diaphragm portion are mounted in the bracket accommodation chamber; the bracket accommodation chamber is further recessed with a gap trough, an inner bottom surface of the bracket accommodation chamber is formed with a mounting surface around the gap trough, the second connecting ring is horizontally mounted on the mounting surface; an outer wall of the bracket accommodation chamber is formed with three spaced notches for the pins to extend therefrom, the pins extend out of the bracket from the corresponding notches respectively, a rear wall of the gap trough is formed with third through holes;

a front cover is disposed at a front of the bracket accommodation chamber, the front cover has a receiving trough, an inner wall of the receiving trough is formed with fourth through holes, a periphery of the front cover extends outward to form an annular flange, the bracket is provided with an engaging protrusion corresponding to the annular flange, the front cover is connected to the bracket, the annular flange is mated with the engaging protrusion;

a rear wall of the bracket is provided with a first annular gasket and a first waterproof net arranged in order corresponding to the third through holes; a rear wall of the bracket, corresponding to the third through holes, is provided with a first annular gasket and a first waterproof net arranged in sequence from front to back, and a front wall of the front cover, corresponding to the fourth through holes, is provided with a second waterproofing net and a second annular gasket arranged in sequence from front to back.

9. The electrostatic headphone as claimed in claim 6, wherein the earphone housing includes a front housing and a rear housing, the front housing is provided with a sound hole; the front housing and the rear housing have a first mounting portion and a second mounting portion corresponding to the notches respectively, the front housing and the rear housing are connected to each other to form a mounting cavity therein, the electrostatic loudspeaker is installed in the mounting cavity; the ear insertion portion is disposed at an end of the rear housing, an outer wall of the ear insertion portion is formed with a groove; the ear insertion portion has a sound chamber, an inner wall of the sound chamber has a limit step, the limit step is provided with a third annular gasket, and the third annular gasket is provided with a third waterproofing net.

10. The electrostatic headphone as claimed in claim 9, wherein the ear insertion portion has a sound tube, and the sound tube has a central axis set at an angle with respect to a central axis of the rear housing.

* * * * *